US006282297B1

(12) United States Patent
Lin

(10) Patent No.: US 6,282,297 B1
(45) Date of Patent: Aug. 28, 2001

(54) ANGLE ADJUSTMENT STRUCTURE FOR SPEAKER SYSTEM

(76) Inventor: Steff Lin, 8FL., No. 18, Lane 30, Kuo Hsing St., His Chih Chen, Taipei Hsien (TW)

( * ) Notice: Subject to any disclaimer, the term of this patent is extended or adjusted under 35 U.S.C. 154(b) by 0 days.

(21) Appl. No.: 09/614,722

(22) Filed: Jul. 12, 2000

(51) Int. Cl.[7] ..... H04R 25/00

(52) U.S. Cl. ..... 381/386; 381/387; 381/390; 381/182

(58) Field of Search ..... 381/182, 186, 381/386, 387, 390, FOR 165, FOR 151, 300, 87, 89, 332, 336; 181/144, 199, 147

(56) References Cited

U.S. PATENT DOCUMENTS 4,365,114 * 12/1982 Soma ..... 381/182
4,811,406 * 3/1989 Kawachi ..... 381/387

* cited by examiner

*Primary Examiner*—Huyen Le
(74) *Attorney, Agent, or Firm*—Bacon & Thomas, PLLC

(57) ABSTRACT

An angle-adjustment structure is constructed to include a support, and a rack pivoted to the support, the support having a cylindrical base installed in a squawker at the center, a zigzag supporting arm raised from cylindrical base, a transverse receptacle formed integral with a middle part of the supporting arm, a compression spring mounted in the receptacle, a steel ball supported on the compression spring and partially extended out of the receptacle, and a transverse axle holder formed integral with a top end of the supporting arm, the rack having two flat mounts horizontally disposed at two opposite lateral sides and adapted to hold a tweeter and a woofer, two parallel top flanges, two lugs respectively forwardly extended from the top flanges and respectively pivoted to two distal ends of the transverse axle holders of the support, a triangular bottom positioning plate vertically downwardly disposed at a bottom side thereof and suspended at one side of the supporting arm of the support and stopped against the steel ball, and a plurality of positioning holes respectively formed on the triangular bottom positioning plate at different elevations and alternatively forced into engagement with the steel ball.

4 Claims, 5 Drawing Sheets

ANGLE ADJUSTMENT STRUCTURE FOR SPEAKER SYSTEM

BACKGROUND OF THE INVENTION

The present invention relates to an angle adjustment structure for speaker system, which supports a woofer and a tweeter in a squawker, enabling the woofer and the tweeter to be simultaneously adjusted to any of a series of angular positions relative to the squawker.

A full-range speaker system is generally comprised of a woofer, a squawker, and a tweeter. The woofer, the squawker and the tweeter are normally arranged in parallel. There is known a speaker system in which the angular position of the tweeter and the woofer can be adjusted to the woofer. According to this design, the tweeter and the woofer are mounted on a rack, which is in turn coupled to a part inside the squawker by a ball socket joint. The angle adjustment structure of this design has numerous drawbacks as outlined hereinafter.

1. The cost of the angle adjustment structure of this design is high because its installation procedure is complicated and, the precision requirement for the ball socket joint is critical.
2. When returning the tweeter and the woofer to the zero-reading position, it is difficult to keep the tweeter and the woofer at the center of the squawker accurately.
3. The tweeter and the woofer may be forced into contact with the paper cone when adjusted to the lowest elevation, affecting the performance of the speaker system.

SUMMARY OF THE INVENTION

It is one object of the present invention to provide an angle adjustment structure for speaker system, which can be conveniently and positively adjusted to one of a series of angular positions. It is another object of the present invention to provide an angle adjustment structure for speaker system, which can be accurately and positively returned to the zero-reading center point position after each adjustment. It is still another object of the present invention to provide an angle adjustment structure for speaker system, which does not touch the paper cone of the squawker in which it is installed when adjusted to the lowest elevation. To achieve these and other objects, there is provided an angle adjustment structure comprised of a support and a rack. The support comprises a cylindrical base installed in a squawker at the center, a zigzag supporting arm raised from cylindrical base, a transverse receptacle formed integral with a middle part of the supporting arm, a compression spring mounted in the receptacle, a steel ball supported on the compression Spring and partially extended out of the receptacle, and a transverse axle holder formed integral with a top end of the supporting arm. The rack comprises two flat mounts horizontally disposed at two opposite lateral sides and adapted to hold a tweeter and a woofer, two parallel top flanges, two lugs respectively forwardly extended from the top flanges and respectively pivoted to two distal ends of the transverse axle holders of the support, a triangular bottom positioning plate vertically downwardly disposed at a bottom side thereof and suspended at one side of the supporting arm of the support and stopped against the steel ball, and a plurality of positioning holes respectively formed on the triangular bottom positioning plate at different elevations and alternatively forced into engagement with the steel ball.

DETAILED DESCRIPTION OF THE PREFERRED EMBODIMENT

Figure 1:
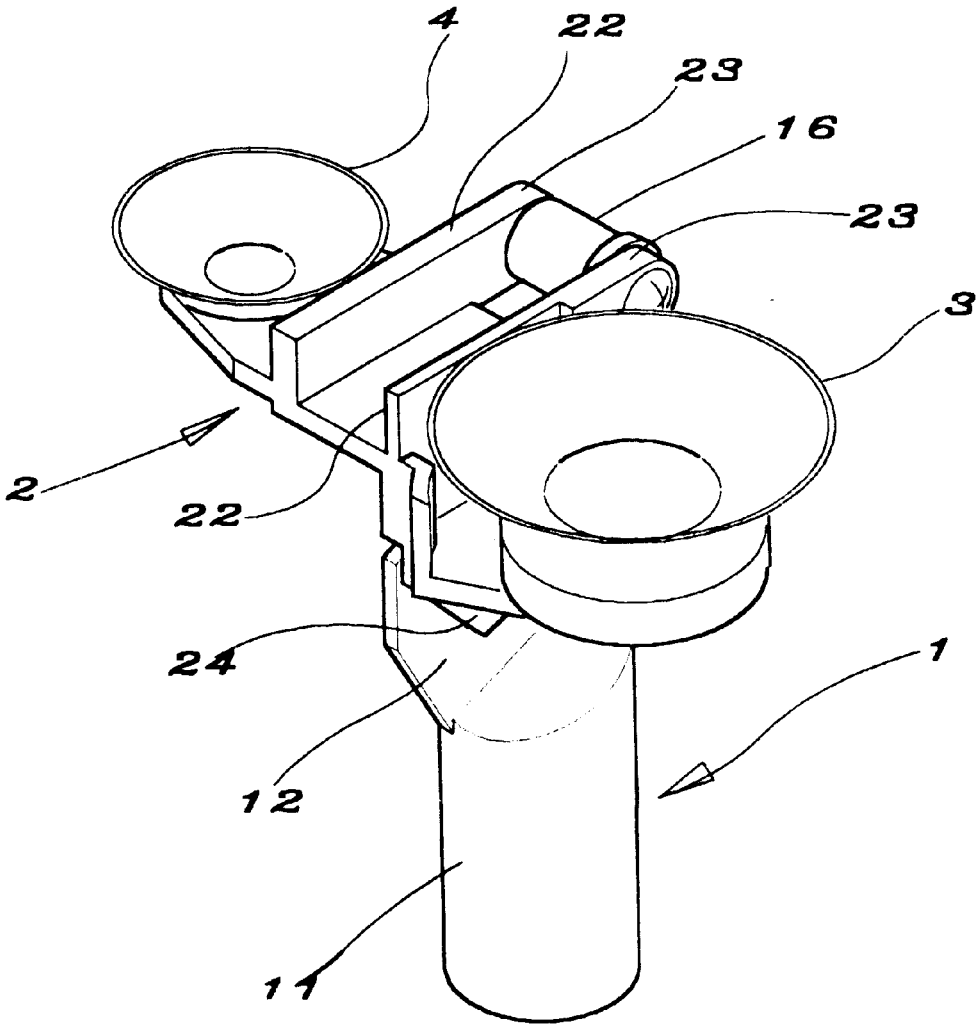
FIG. 1 is an elevational view of an angle adjustment structure for speaker system according to the present invention.
Figure 2:
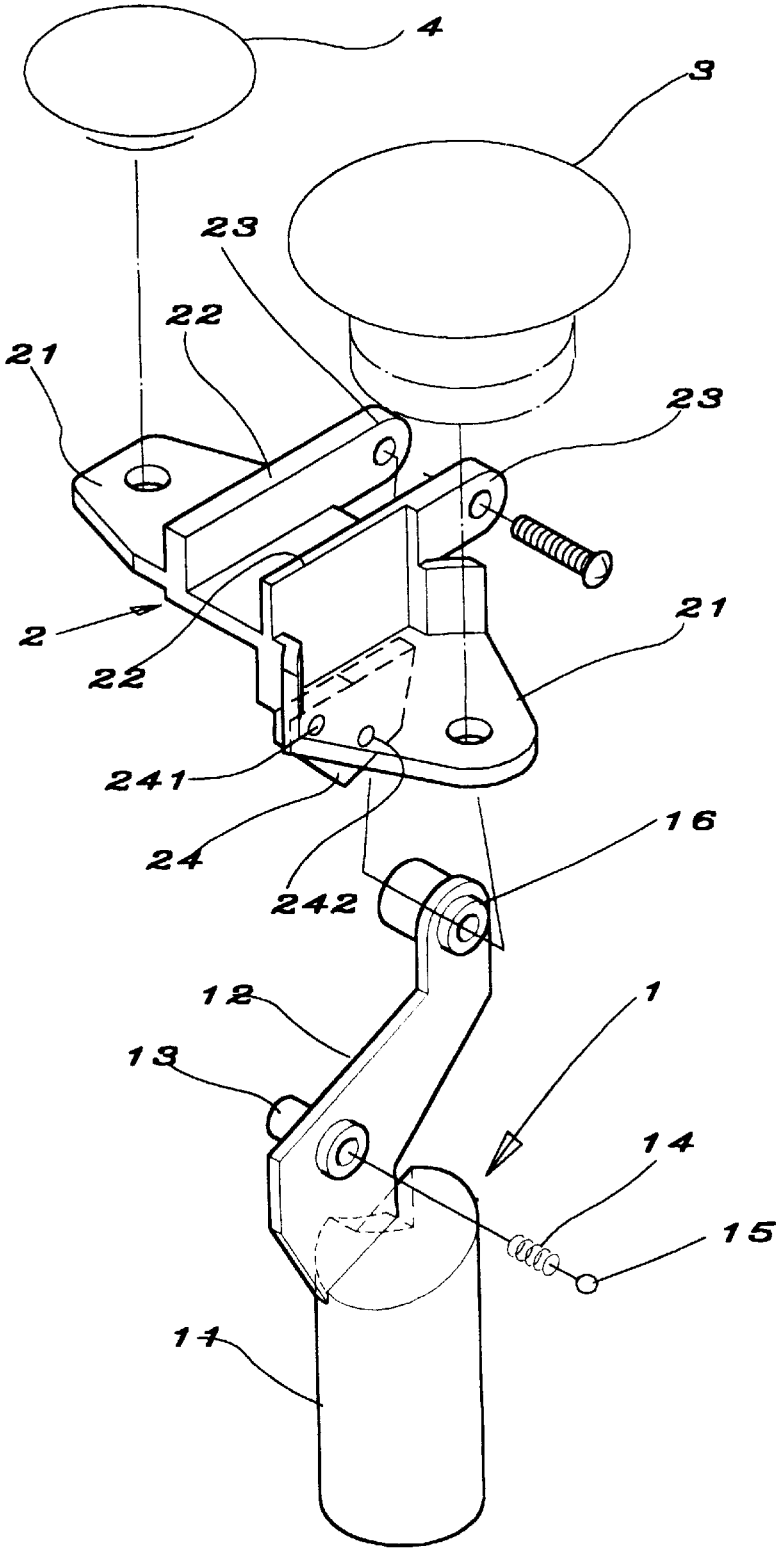
FIG. 2 is an exploded view of the angle adjustment structure shown in FIG. 1.

Referring to FIGS. 1 and 2, an angle adjustment structure in accordance with the present invention is generally comprised of a support 1, and a swivel rack 2. The support 1 comprises a cylindrical base 11, a zigzag flat supporting arm 12 upwardly extended from the top side of the cylindrical base 11, a transverse receptacle 13 formed integral with a middle part of the zigzag flat supporting arm 12, a compression spring 14 mounted in the receptacle 13, a steel ball 15 supported on the compression spring 14 and partially extended out of the receptacle 13, and a transverse axle holder 16 formed integral with the top end of the zigzag flat supporting arm 12. The rack 2 comprises two flat mounts 21 horizontally disposed at two opposite lateral sides and adapted to hold a tweeter 3 and a woofer 4, two parallel top flanges 22, two lugs 23 respectively forwardly extended from the top flanges 22, a triangular bottom positioning plate 24 vertically downwardly disposed at the bottom side, and a plurality of positioning holes 241 and 241 respectively formed on the triangular bottom positioning plate 24 at different elevations.

Figure 3:
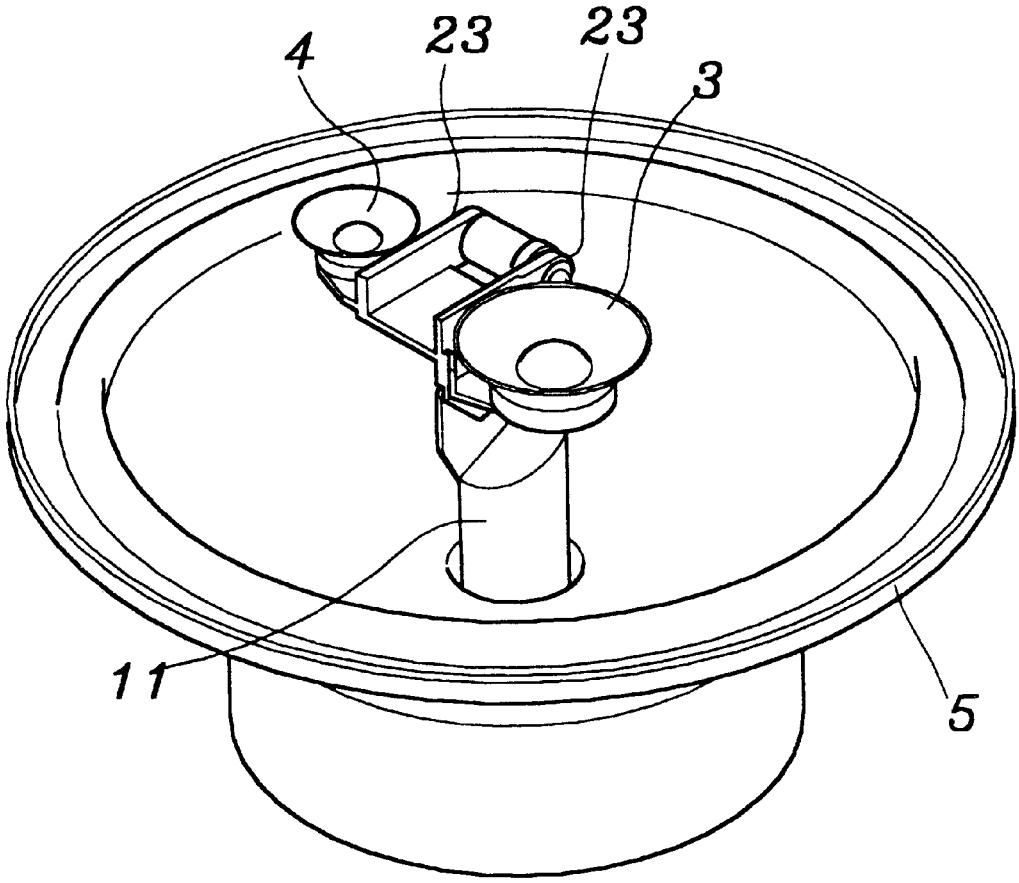
FIG. 3 is an applied view of the present invention, showing the angle adjustment structure installed in a squawker.

The assembly process of the present invention is outlined hereinafter with reference to FIG. 3, the cylindrical base 11 of the support 1 is installed in a squawker 5 at the center, and then the lugs 23 of the rack 2 are pivotally connected to two distal ends of the transverse axle holder 16 by pivot means, enabling the triangular bottom positioning plate 24 to be suspended at one side of the zigzag supporting arm 12 and stopped at the steel ball 15, and then a tweeter 3 and a woofer 4 are respectively mounted on the flat mounts 21.

Figure 4B:
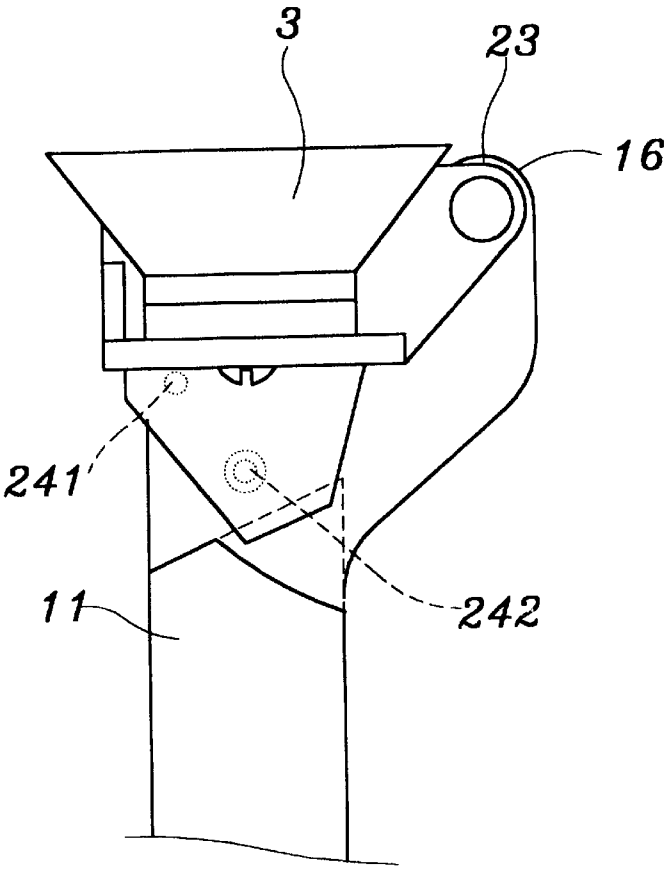
FIG. 4*b* is a side view of FIG. 4*a*.
Figure 4A:
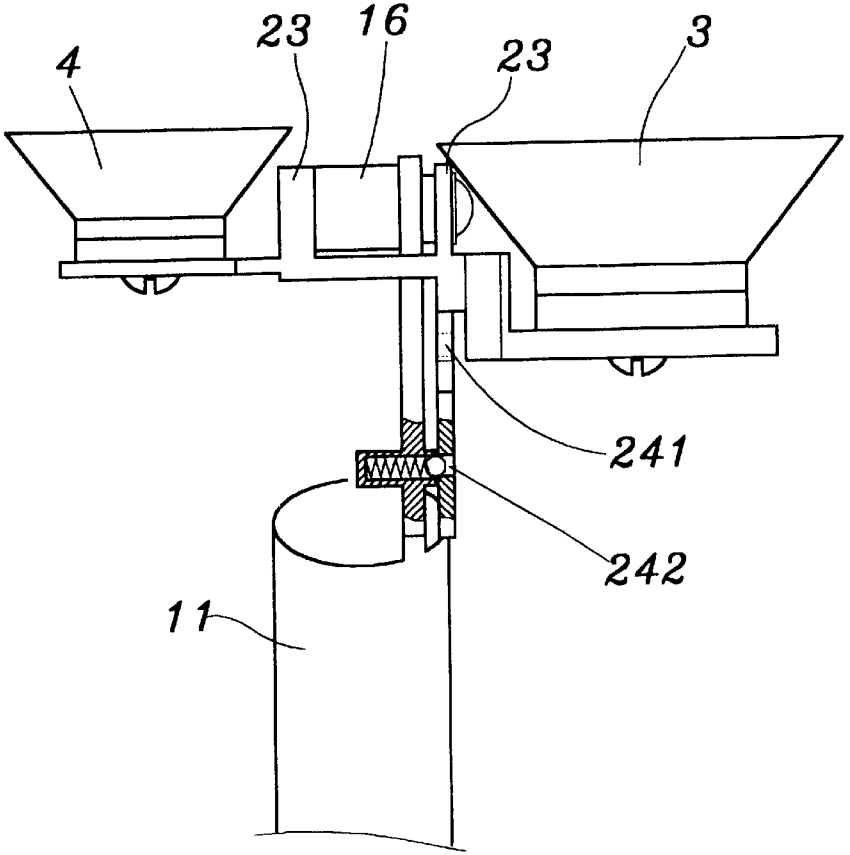
FIG. 4*a* is a sectional view of a part of the present invention, showing the steel ball engaged into one positioning hole on the rack.

Referring to FIGS. 4*a* and 4*b*, when assembled, the steel ball 15 is engaged into one positioning hole 241 or 242 on the triangular bottom positioning plate 24 to hold the rack 2 in position.

Figure 5:
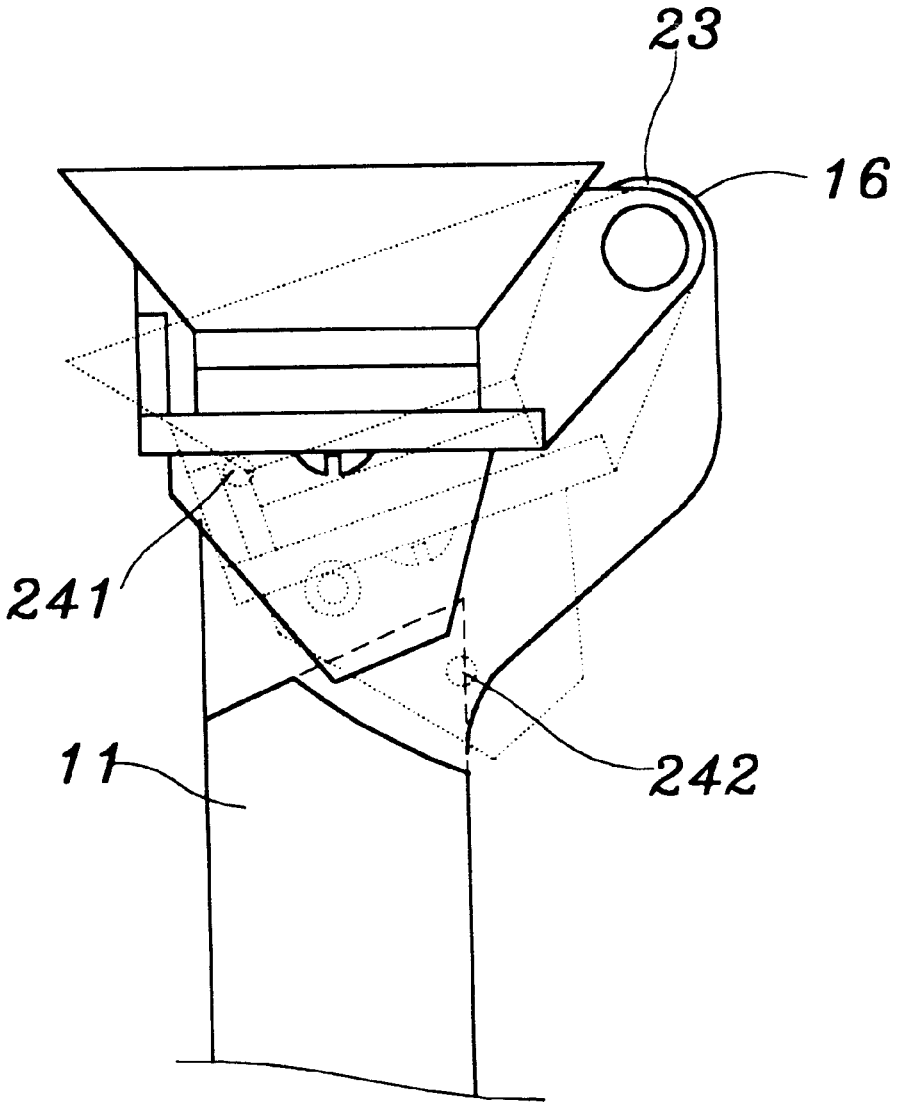
FIG. 5 is a schematic drawing showing the adjustment of the angular position of the rack on the support.

Referring to FIG. 5, when adjusting the angular position of the tweeter 3 and the woofer 4, the rack 2 is moved by hand and turned about the transverse axle holder 16 to move the triangular bottom positioning plate 24 over the steel ball 15 and to change the engagement between the steel ball 15 and the positioning holes 241 and 242. When adjusted, the steel ball 15 is engaged into the corresponding positioning hole 241 or 242 to hold the rack 2 in the adjusted position.

While only one embodiment of the present invention has been shown and described, it will be understood that various modifications and changes could be made thereunto without departing from the spirit and scope of the invention disclosed.

What the invention claimed is:

1. An angle-adjustment structure comprising:

a support. said support comprising a cylindrical base installed in a squawker at the center, a supporting arm upwardly extended from the topmost edge of said cylindrical base, a transverse receptacle formed integral with a middle part of said supporting arm, a compression spring mounted in said receptacle, a steel ball supported on said compression spring and partially extended out of said receptacle, and a transverse axle holder formed integral with a top end of said supporting arm; and a rack mounted on said support, said rack comprising two flat mounts horizontally disposed at two opposite lateral sides and adapted to hold a tweeter and a woofer, two parallel top flanges, two lugs respectively forwardly extended from said top flanges and respectively pivoted to two distal ends of said transverse axle holders of said support, a triangular bottom positioning plate vertically downwardly disposed at a bottom side thereof and suspended at one side of said supporting arm of said support and stopped against said steel ball, and a plurality of positioning holes respectively formed on said triangular bottom positioning plate at different elevations and alternatively forced into engagement with said steel ball.

2. The angle-adjustment structure of claim 1 wherein said supporting arm of said support is a zigzag flat arm.

3. The angle-adjustment structure of claim 1 wherein said positioning holes of said rack are so arranged that the tweeter and woofer carried on said rack are disposed at the center of the squawker when said rack is turned about said axle holder to the topmost elevation.

4. The angle-adjustment structure of claim 1 wherein said positioning holes of said rack are so arranged that the tweeter and woofer carried on said rack are spaced from the paper cone of the squawker at a distance when said rack is turned about said axle holder to the lowest elevation.

* * * * *